US010704851B1

(12) United States Patent
Redillo

(10) Patent No.: US 10,704,851 B1
(45) Date of Patent: Jul. 7, 2020

(54) TAKEDOWN PIN AND BOLT CATCH FOR A FIREARM

(71) Applicant: Judie Redillo, Panorama C/ity, CA (US)

(72) Inventor: Judie Redillo, Panorama C/ity, CA (US)

( * ) Notice: Subject to any disclaimer, the term of this patent is extended or adjusted under 35 U.S.C. 154(b) by 0 days.

(21) Appl. No.: 16/236,494

(22) Filed: Dec. 29, 2018

(51) Int. Cl.
*F41A 17/42* (2006.01)
*F41A 11/00* (2006.01)
*F41A 17/36* (2006.01)

(52) U.S. Cl.
CPC ..... *F41A 11/00* (2013.01); *F41A 17/36* (2013.01); *F41A 17/42* (2013.01)

(58) Field of Classification Search
CPC ..... F41A 17/42; F41A 3/72; F41A 3/68
USPC ..... 42/70.02, 17, 16, 70.01; 89/138, 137, 89/153, 180, 181, 190
See application file for complete search history.

(56) References Cited

U.S. PATENT DOCUMENTS 7,661,219 B1 * 2/2010 Knight, Jr. ..... F41A 3/42 42/70.02
7,937,876 B1 5/2011 Graham
8,359,966 B1 * 1/2013 Brotherton ..... F41A 17/36 42/70.02
8,695,477 B2 4/2014 Esch
8,826,797 B2 9/2014 Overstreet et al.
8,943,866 B2 2/2015 Fernandez et al.
9,010,004 B1 4/2015 Fu
9,091,499 B2 7/2015 Overstreet et al.
9,243,857 B2 1/2016 Mills et al.
9,291,412 B1 * 3/2016 Montes ..... F41A 17/36
9,651,328 B1 * 5/2017 Oglesby ..... F41A 35/06
10,151,550 B2 * 12/2018 Borders ..... F41A 3/72
10,234,226 B1 * 3/2019 Copeland ..... F41A 17/38
2003/0208940 A1 * 11/2003 Johnson ..... F41A 3/12 42/18
2010/0275485 A1 * 11/2010 Findlay ..... F41A 17/36 42/16
2011/0056107 A1 * 3/2011 Underwood ..... F41A 9/59 42/18
2011/0247482 A1 * 10/2011 Overstreet ..... F41A 9/70 89/138
2011/0247483 A1 * 10/2011 Overstreet ..... F41A 9/70 89/138

(Continued)

FOREIGN PATENT DOCUMENTS

CA 2887087 A1 * 4/2014 ..... F41A 17/36

*Primary Examiner* — Jonathan C Weber
(74) *Attorney, Agent, or Firm* — Diament Patent Law, P.C.; Adam Diament

(57) ABSTRACT

The present invention is for a rear takedown pin and a bolt catch for use in a firearm such as an AR-15. The rear takedown pin has an elongated recess, a track, a slot, and a spring along an elongated cylindrical body that allows an upper and lower receiver of a firearm, such as an AR-15, to disengage, while the pin remains in the upper and lower receiver holes, thereby allowing a user to quickly replace a magazine without the barrel of the firearm rotating away from the preset aimed position. The invention also includes a bolt catch that allows a user to toggle a release to keep a bolt in its open opinion as well as provides a retractable pin that complies with magazine release lock regulations so a user can quickly replace a spent magazine.

7 Claims, 15 Drawing Sheets

(56) References Cited

U.S. PATENT DOCUMENTS

| | | | | |
|---|---|---|---|---|
| 2011/0283580 | A1* | 11/2011 | Esch | F41A 17/42 42/14 |
| 2012/0167424 | A1* | 7/2012 | Gomez | F41A 17/42 42/14 |
| 2013/0055610 | A1 | 3/2013 | Watkins | |
| 2014/0060310 | A1* | 3/2014 | Overstreet | F41A 3/68 89/138 |
| 2016/0348991 | A1* | 12/2016 | Tisone | F41A 9/59 |
| 2017/0184361 | A1 | 6/2017 | Cheng | |
| 2017/0227312 | A1 | 8/2017 | Christensen | |
| 2017/0234638 | A1* | 8/2017 | Noonan | F41A 17/36 89/138 |

* cited by examiner

TAKEDOWN PIN AND BOLT CATCH FOR A FIREARM

CROSS-REFERENCE TO RELATED APPLICATIONS

None.

FEDERALLY SPONSORED RESEARCH OR DEVELOPMENT

None.

FIELD OF THE DISCLOSURE

The present invention relates to parts for a semi-automatic firearm, and more specifically to a takedown pin and bolt catch for a firearm.

BACKGROUND OF THE INVENTION

Semi-automatic firearms have been used for a long time. A semi-automatic firearm allows only one bullet to be fired every time the trigger is pulled by a user. A civilian version of a common military firearm is the AR-15. The AR-15, as well as other firearms, have a detachable magazine, which allows a user to fire the gun until all of the bullets in the magazine have been depleted. Once depleted, the user removes the empty magazine by pushing a magazine release button, which releases the empty magazine from the firearm. The user then loads a full magazine by pushing a new magazine against the firearm to lock it in place. The user can then resume firing the firearm.

Although quick release magazines are practical for the user to be able to resume firing after one magazine has emptied, regulations have been put in place that slow down this process. In order to be compliant with some state regulations, the magazine can only be released from the firearm when the upper and lower receivers are separated from each other. If not separated, the magazine remains locked to the firearm so that the emptied magazine cannot be removed, and prevents the user from inserting a new magazine.

The purpose of requiring the upper and lower receivers to separate from each other is to slow down the user from replacing magazines too quickly, by requiring multiple manual steps to replace the magazine and enable to firearm to be capable of firing again. However, the required separation of the upper and lower receivers to replace magazines imposes physical drawbacks besides slowing down the user. First, when the upper and lower receivers separate, the front part of the firearm (the barrel) swivels down. Due to this swiveling of upper receiver, the user must therefore be careful when releasing the upper and lower receivers because as the upper receiver swivels down, the upper receiver can hit the user's hand. Second, when the upper receiver swivels down, the user also loses the aim achieved while firing the with the first magazine because the upper receiver, when swiveled, no longer points to the position the barrel was pointing when the user fired while the first magazine was loaded.

Sometimes it is desirable for magazines to be firmly mounted to a firearm when in use, and then quickly and easily released from the rifle for rapid replacement. Many firearms have a mechanism the user can manipulate to release the magazine from its positive engagement with the firearm or rifle. Typically, the rifle bolt must be held in a back, or open position, in order to exchange magazines. After a new magazine has been attached to the rifle, the bolt must be released to slide forward, usually loading a new round in the chamber as it does so.

A bolt catch mechanism catches a bolt in its rearward position and, when manipulated by the user, releases the bolt after the magazine has been replaced. In some situations, such as removing a jammed item, or when the user wants to inspect the bolt, rapid redeployment of the weapon is not an issue, and the user is not concerned with moving quickly. However, in training or combat, minimizing downtime can be mission critical.

More particularly, this multi-step process in loading a new magazine requires the user to stop firing, move the rifle out of firing position, focus on the bolt, the bolt catch-release mechanism, and the magazine to effectuate a successful reload. In some cases, the user must switch hands when holding the rifle in order to manipulate the bolt carrier, the bolt catch-release mechanism, and the magazine. Not only is this time-consuming and somewhat clumsy, it also reduces the effectiveness of the user in maintaining fire control in a combat situation. Furthermore, with respect to bolt catches, many bolt catches are not state compliant (such as California) because while the bolt catch may hold the bolt in a rearward position, it still allows a user to release a magazine when the firearm is still in a configuration where the upper and lower receivers of the firearm are still connected, which is not legal in many states.

Numerous firearms and parts of firearms parts have been proposed to aid in the firing of weapons by making it easier to load and aim by proposing modifications to takedown pins, bolt catches, or other components. For example, U.S. Pat. Pub. No. 20130055610 to Watkins discloses a shim supported upon a pivot pin between an upper and lower receiver of an AR-15. U.S. Pat. No. 8,826,797 to Overstreet discloses a modifiable upper receiver for M-16/AR15 type firearm in particular for adapting to specific needs of right and left-handed shooters. U.S. Pat. No. 8,943,866 to Fernandez discloses a magazine lock and breech lock. U.S. Pat. Pub. No. 20170227312 to Christensen discloses a firearm lower receiver with non-detachable magazine. U.S. Pat. No. 9,010,004 to Fu discloses systems and methods for locking and releasing detachable firearm magazines. U.S. Pat. No. 9,243,857 to Mills discloses a firearm pin having a track for a detent. U.S. Pat. No. 9,777,977 to Makaron discloses a device for facilitating disassembly of a firearm and release of a magazine. U.S. Pat. No. 7,937,876 to Graham discloses a firearm pin component to simplify the process where an upper receiver is engaged with and disengaged from a lower receiver of a firearm. U.S. Pat. No. 9,091,499 to Overstreet disclose a bolt hold open actuator for use with AR-15/M16 type firearms. U.S. Pat. No. 8,695,477 discloses a bolt catch-release lever in a manner that does not require disassembly of the firearm or disassembly or removal of the catch-release actuator from the firearm, and U.S. Pat. Pub. No. 20170184361 to Cheng discloses a gun device with bolt catch. The contents of all patents and patent publications in the entirety of this application are incorporated in their entireties for all purposes, as if fully discloses herein. While many of the references above attempt to solve some needs of a user, by allowing quick and easy magazine replacement, there still remains a need for improved devices that are compliant with current regulations, and specifically state laws that require separation of upper and lower receivers in a firearm, and bolt catches, to allow a user to quickly replace magazines in firearms.

BRIEF SUMMARY OF THE PRESENT INVENTION

It is an object of the present invention to minimize the repositioning of the barrel of the firearm when changing magazines. The present invention uses a novel and inventive takedown pin that allows for the upper receiver to disengage with the lower receiver in a sufficient amount that unlocks the magazine, but prevents the upper receiver (and thus the barrel) from rotating more than a few degrees. The design of the rear takedown pin catches the upper receiver after disengaging from the lower receiver, thus allowing the user to 1) quickly disengage the upper receiver from the lower receiver by pressing the rear takedown pin, 2) quickly remove the spent magazine, 3) attach a new magazine, and 4) reengage the upper receiver with the lower receiver, all without having to fully remove the rear takedown pin from the upper and lower receiver connection area, but rather merely press the rear takedown pin while the rear takedown pin remains within the rear takedown pin hole.

In one aspect, there is a takedown pin that is modified for quick release that is compliant with regulations that require the upper and lower receives of a firearm, such as the AR-15, to be separated, in order for the magazine to unlock. With the push of a button, the upper receiver separates from the lower receiver to disable the firing mechanism and magazine, lock only a minimal amount, but enough to be compliant and prevent the trigger from firing a new round. The takedown pin is designed and configured such that it does not allow the front portion (upper receiver) of the firearm to fully swivel down, but rather, only allows the upper receiver to swivel a few degrees at most, but enough to be compliant with regulations. When the upper and lower receiver are separated, even by only a few degrees, the magazine release is operable so that the user can press a magazine release button to release the magazine and attach a new and fully loaded magazine. By preventing the upper receiver from rotating fully around the lower receiver, the user's hands are protected from being sandwiched between the upper and lower receiver. One advantage of this configuration is that the user can maintain aim between replacement of the magazines because the barrel of the firearm only swivels slightly when released. To make the firearm operable to fire, only a quick tap down of the upper receiver against the lower receiver is required. By tapping the upper receiver against the lower receiver, the spring loaded takedown pin locks reengages the receivers in their locked position such that the trigger can now be operated to fire the firearm.

In another aspect of the present invention there is a firearm pin device comprising an elongated cylindrical body having a proximal end and a distal end, an elongated recess within the elongated cylindrical body between the proximal and distal end, a slot disposed within the elongated cylindrical body at the proximal end, a track at the distal end of the elongated cylindrical body having an open distal end, a spring member disposed within the slot, the spring member having a proximal end and a distal end, a ring member disposed partially within the slot and adjacent to the spring member, and a knob adjacent the proximal end the slot. When a user presses the knob the elongated recess laterally shifts to disengage an upper receiver of a firearm with a lower receiver of the firearm while the firearm pin remains within both the upper receiver and lower receiver of the firearm.

In another aspect, there is bolt catch device for a firearm having a bolt, the bolt catches slides between a latched (locked rearward) and an unlatched position (allows forward progress of the bolt). The bolt is held in the latched position by the bolt catch being pivotably mounted to the firearm to provide for latching and unlatching of the bolt by the user. The bolt catch has a substantially L-shaped main body, the main body having a first leg and a substantially perpendicular second leg, a bolt catch projection for catching a bolt, a spring member disposed within a hole in the first leg of the main body, a magazine release blocking pin at least partially disposed and partially retractable within a hole on a bottom side of the second leg, a pad for toggling the bolt catch into a latching and unlatching position for a bolt, and an elongated main body aperture sized to fit a rotation pin that allows the bolt catch to rotate around the axis of the rotation pin and allow the bolt catch to rise and lower in response to force exerted by the spring member.

DETAILED DESCRIPTION OF EMBODIMENTS

Figure 1:
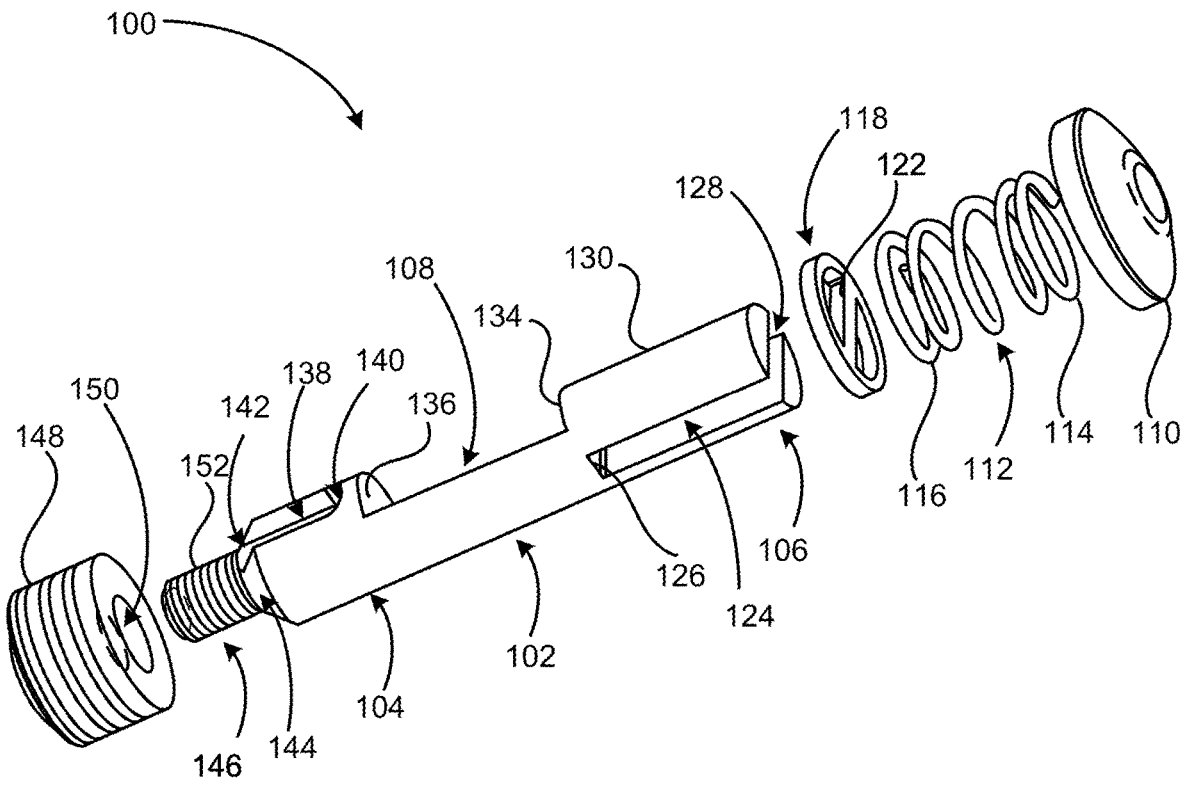
FIG. 1 is a perspective exploded view of a rear takedown pin according to one embodiment of the invention.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein.

One present inventive device relates to a rear takedown pin for firearms as shown in isolation in FIGS. 1-4, and with frame of reference to firearm (such as an AR-15) in FIGS. 5-12 and 15. As used herein and throughout, "takedown pin" refers to the pin that secures and the upper receiver of the firearm to the lower receiver of the firearm. It is to be understood, however, that the inventive takedown pins disclosed herein may be utilized on takedown pins designed and/or implemented for use on a variety of differently designed and configured upper and lower receivers for any number of firearms, wherein the basic principle of design and operation of the inventive takedown pins are the same.

Figure 2:
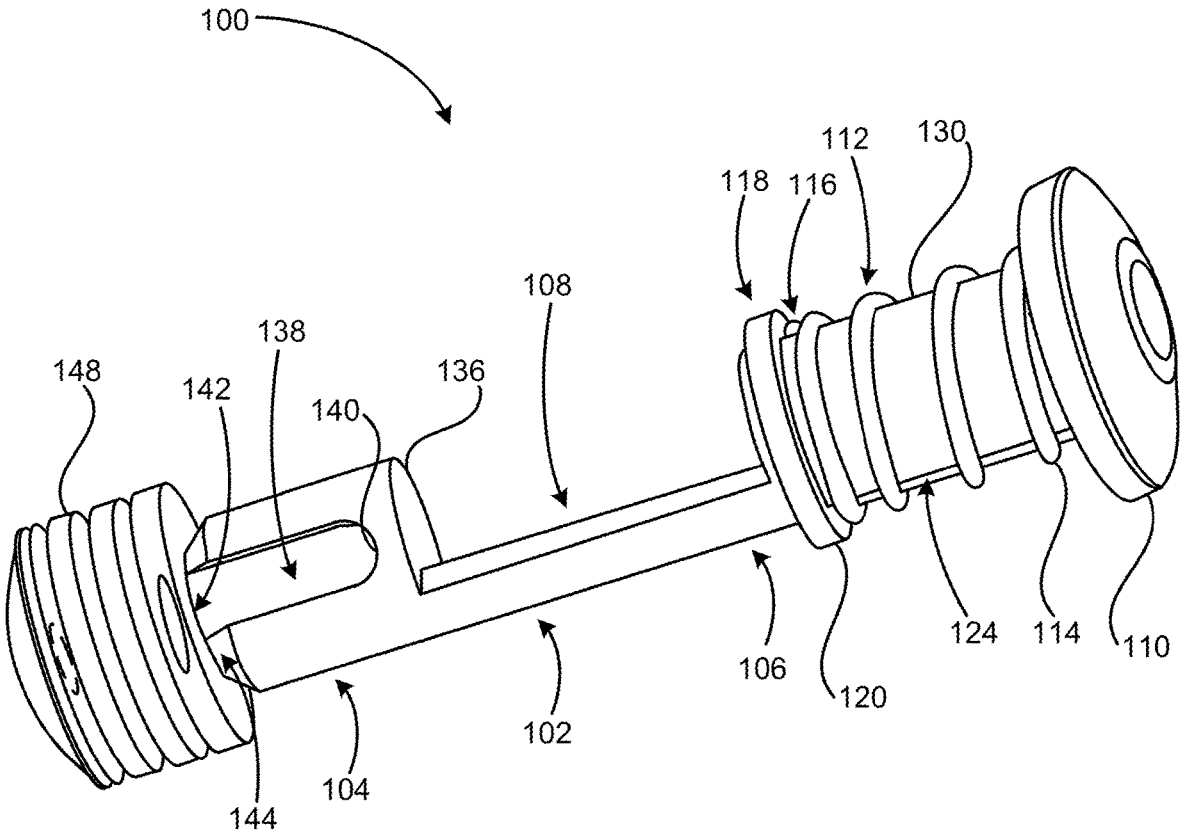
FIG. 2 is a perspective assembled view of the rear takedown pin of FIG. 1.
Figure 3:
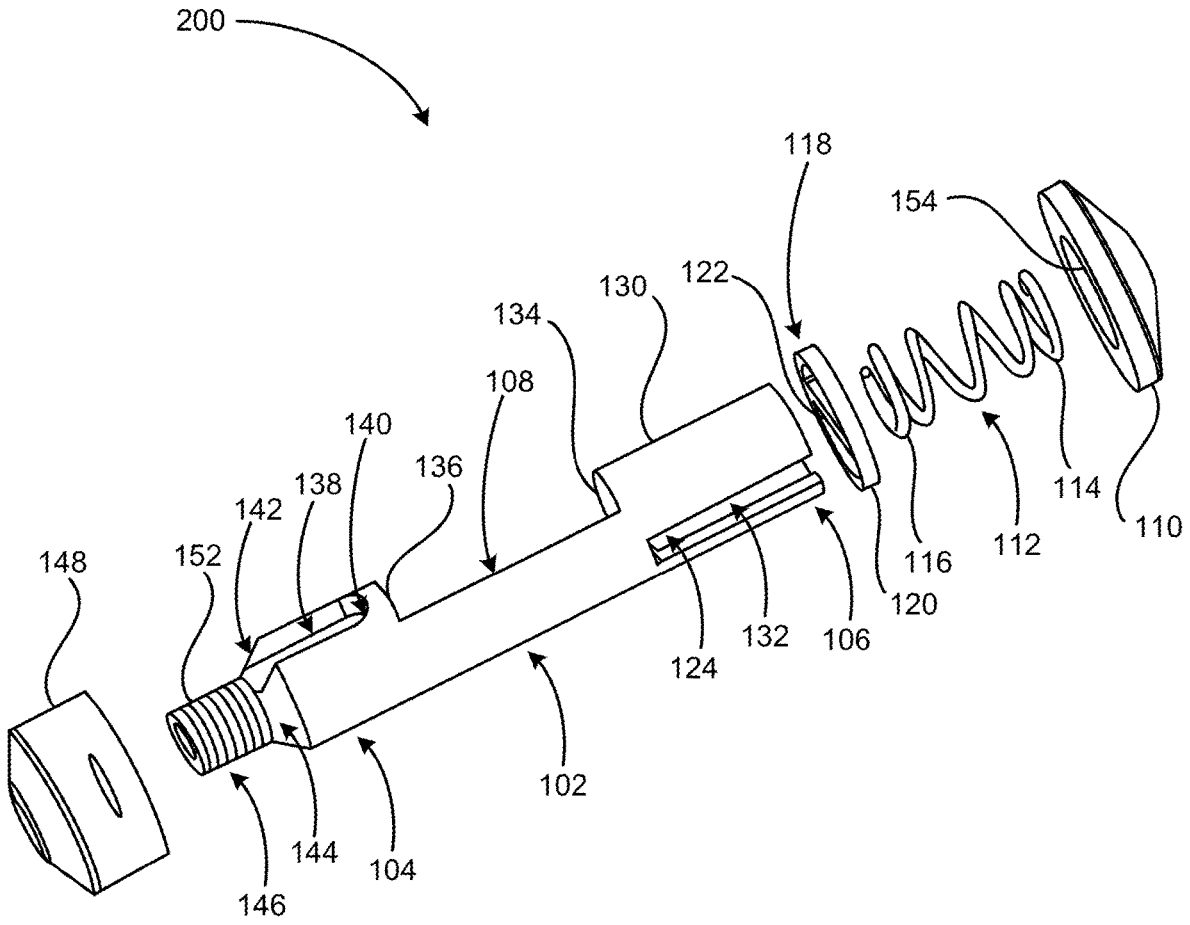
FIG. 3 is a perspective exploded view of another embodiment of a rear takedown pin.
Figure 4:
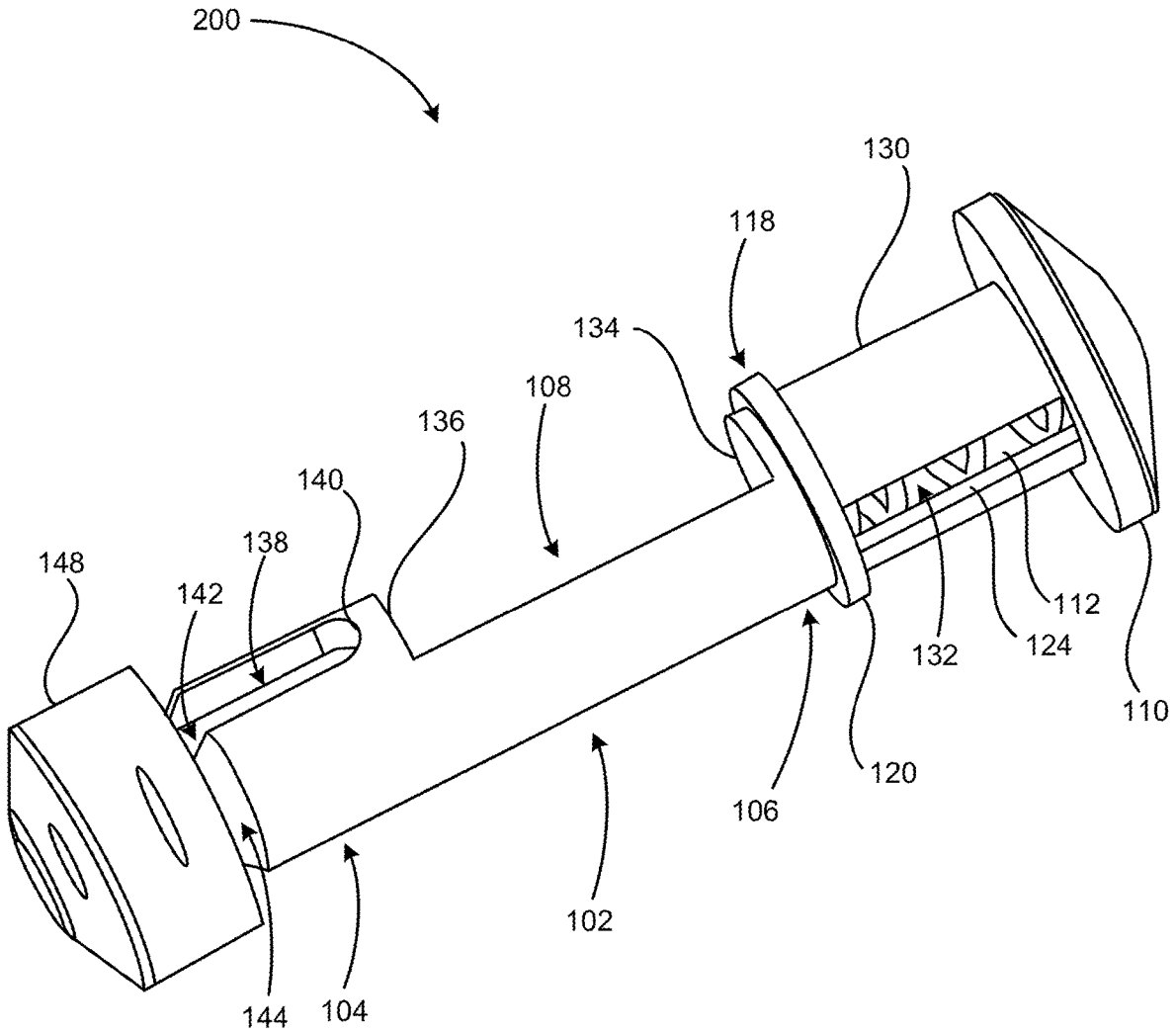
FIG. 4 is a perspective assembled view of the rear takedown pin of FIG. 3.

Turning to the Figures to describe embodiments of rear takedown pin embodiments of the present invention first with reference to the rear takedown pin exemplified as one embodiment in FIGS. 1-2. FIG. 1 illustrates an exploded view of the embodiment of a rear takedown pin 100 and FIG. 2 illustrates an assembled view of the rear takedown pin 100. FIGS. 3 and 4 illustrate a second embodiment of a variation a rear takedown pin 200 in exploded view and assembled view, respectively. Turning to FIGS. 1 and 2, an exemplary rear takedown pin 100 with a spring member 112 positioned on the outside of the pin 100, and an exemplary rear takedown pin 200 is shown in FIGS. 3 and 4 having a spring member 112 on the inside on the pin. It shall be understood that the pins 100, 200 shall not be limited to the embodiments depicted in the figures as the depicted embodiments are exemplary and provided for illustrative purposes only. It is also herein noted that many of the features shown and described for rear takedown pins 100, 200 are essentially identical to each other. Accordingly, those essentially identical features may be identified with the same reference numbers, and those features that are distinct shall be shown and described with reference to different reference numerals.

Referring to FIGS. 1-4, the pins 100, 200 each have an elongated cylindrical body 102, wherein the body 102 has a distal end 104 and a proximal end 106. Between the distal and proximal ends 104, 106, is an elongated recess 108. The recess 108 can be a variety of sizes and shapes but in one embodiment, the recess is approximately 0.5 inches (approximately 1.27 cm) and the length of the entire pin 100, 200 is approximately 1.63 inches (approximately 4.14 cm). All measurements may be in a range of plus or minus 5%, 10%, 15%, 20%, 30%, 40%, 50% or more, to accommodate the width of the firearm where the pin 100, 200 is inserted to secure the upper receiver 10 and lower receiver together 30 (shown in FIGS. 5-7 and described in detail below). The elongated recess 108 of the pin 100, 200 allows the upper receiver 10 to have space to slightly disengage with the lower receiver 30, while the pin 100, 200 remains within the rear takedown lug hole 13 and lower receiver takedown pin holes 34, 36 (one on each side of the lower receiver 30, as shown most clearly in FIGS. 10 and 12).

Disposed on proximal end 106 is a positioning member 110, which is in the form of a knob 110. The knob 110 is designed to facilitate the rear takedown pin 100, 200 so that when the knob 110 is pressed by a user, the elongated cylindrical body 102 is pushed toward the distal end 104, and the elongated recess 108 shifts away from the knob 110 to align with components in the firearm 5 to disengage the upper receiver 10 from the lower receiver 30.

The knob 110 is sized such that its diameter is larger than the lower receiver takedown pin holes 34, 36, so that the entirety of the pin 100, 200 cannot pass through the holes 34, 36. This configured design keeps the pin 100, 200 positioned within the firearm 5. The knob 110 is adjacent to the spring member 112 at a first end 114, and the second end 116 of the spring member 112 is adjacent to a ring member 118. The ring member 118 has an outer circumference 120 and a ring member rib 122 that substantially bisects the ring member 118. The ring member rib 122 is designed, sized, shaped, and adapted to fit within a slot 124 disposed on the proximal end of the elongated cylindrical body 106. The slot 124 has a slot distal end 126 and slot proximal end 128 (shown in FIG. 1). The inner circumference of the spring member surrounds the outer circumference of the elongated cylindrical body 102.

The ring member 118 slides over the elongated cylindrical body 102 along the slot proximal end 128 with the ring member rib 122 placed through the slot 124 thereby resting adjacent the slot distal end 126. The outer circumference of the ring member 120 forms a flange that the spring member 112 rests against when assembled, as shown in FIG. 2.

In an alternative embodiment of a pin 200, as shown in FIGS. 3 and 4, the proximal end 106 of the elongated cylindrical body 102 is substantially hollow, which allows the spring member 112 be disposed within the hollow proximal end 132 (i.e. a substantially hollow region) of the elongated cylindrical body. This embodiment shown in FIGS. 3 and 4 protects the spring member 112 by not having the spring member 112 exposed on the outer circumference of the elongated cylindrical body 130. In either embodiment, as the knob 110 is pushed in by the user, the spring member 112 is compressed, thereby pressing against the ring member 118, thereby causing a force on the slot distal end 126, forcing the elongated recess 108 toward the distal end 104 of the elongated cylindrical body to shift and move into a position where the upper receiver 10 can disengage with the lower receiver 30.

Turning to the spring member 112, the spring member 112 may be of a variety of sizes, and in one embodiment the wire diameter is approximately 0.032 inches (0.81 mm), the diameter from the inner coils is approximately 0.25 inches (6.35 mm), and the length of the spring member is approximately 0.6 inches (15.24 mm). The ring member 118 is sized to form a base that the spring member 112 contacts. The diameter of the ring member 118 from the outer circumference of the ring 120 is approximately 0.32 inches (8.13 mm) and the rib 122 is approximately 0.25 inches (6.35 mm) in length, and width is approximately 0.03 inches (0.76 mm). The knob 110 is sized to fit the proximal end of the spring 114 and in one embodiment, is approximately 1.25 inches (31.75 mm) in length, and has a diameter of approximately 0.45 inches (11.43 mm), and includes a recess 154 where the spring member 112 is positioned, the recess approximately 0.247 inches.

Turning to the elongated recess 108, the elongated recess 108 has an elongated recess proximal end 134 and an elongated recess distal end 136, and in one embodiment, has a length of approximately 0.5 inches (12.7 mm). On the distal end of the elongated cylindrical body 104 is a track 138 having a track proximal end 140 and an open track distal end 142. The track 138 is adapted, sized, and shaped to fit a detent 19 (shown in FIGS. 5 and 11) located in the rear takedown pin hole 36 of the lower receiver 30, such that the detent 19 is designed to align the pin 100, 200, and most importantly the recess 108, such that the recess 108 allows the upper receiver 10 and lower receiver 30 to slightly separate when the user presses the knob 110 of the pin 100, 200.

The detent 19 may be retractable so that the user can manually (such as by finger), retract the detent 19 to fit within the track 138 and prevent the pin 100, 200 from rotating within the firearm 5. The track 138 may be a variety of shapes and sizes, and in one embodiment is approximately 0.045 inches (1.1 mm) in depth and has a width of approximately 0.095 inches (2.4 mm) and length of approximately 0.291 inches (7.4 mm). The track 138 may also have a widened portion on its distal end 142 to first engage, and then guide the detent 19 into the track 138 toward the proximal end 140 of the track 138. As previously discussed, all dimensions are approximations that can work with the present invention, but can be in a range of plus or minus 5%, 10%, 15%, 20%, 30%, 40%, 50% or more to accommodate various firearm components and dimensions.

Disposed at the distal end of the elongated cylindrical body 104 is a tapered region 144 that assists in guiding the detent 19 into the track 138. The tapered region 144 can be a variety of shapes and angles, and in one embodiment is approximately 40 degrees relative to the longitudinal axis of the pin 100, 200. Other values of the degrees of the tapered region 144 may be between 10 and 80 degrees or have no tapering at all. Embodiments where the elongated cylindrical body 102 has no tapered region may also work without detracting from the spirit of the invention.

Also disposed on the distal end of the elongated cylindrical body 104, and along the same longitudinal axis, is a projection 146 having a smaller diameter than the elongated cylindrical body 102. The projection 146 is sized to fit an end cap 148 having a diameter larger than the diameter of the elongated cylindrical body 102, such that when the end cap 148 is attached to the projection 146, the pin 100, 200 cannot be withdrawn from the rear takedown pin holes 34, 36, thus securing the upper receiver 10 to the lower receiver 30, and preventing the upper receiver 10 from overly separating (by more than approximately 0.5 cm to 3 cm) from the lower receiver 30.

The embodiments shown in FIGS. 3-6 show the projection 146 having threads 152. The end cap 148 has an end cap receiving hole 150 to receive the projection 146. Within the receiving hole 150, there are complementary threads that complement the threads 152 of the projection 146. Other types of connection means may also be used to attach the end cap 148 to elongated cylindrical body 102 besides the shown threaded interface without detracting from the spirit of the invention, such as a snap or clip. The receiving hole 150 may be tapered to match the tapering of tapered region 144 of the elongated cylindrical body 102. In one embodiment, the tapered angle is approximately 40 degrees to match a 40 degree tapering of the tapered region 144 of the elongated cylindrical body. The end cap 148 may be of a variety of sizes, and in one embodiment is cylindrical, having a diameter of about 0.375 inches (9.53 mm) and height of approximately 0.27 inches (6.86 mm). The projection 146 in one embodiment is approximately 0.23 inches (7.62 mm) in length.

In the embodiment shown in FIGS. 3 and 4, because the spring member 112 is on the outer circumference of the elongated cylindrical member 130, the wire diameter of the spring member 112 is approximately 0.022 inches (0.56 mm), and the outer diameter of the spring's entirety is approximately 0.18 inches (4.57 mm), and the spring member is approximately 0.5 inches (12.7 mm) in length.

Figure 5:
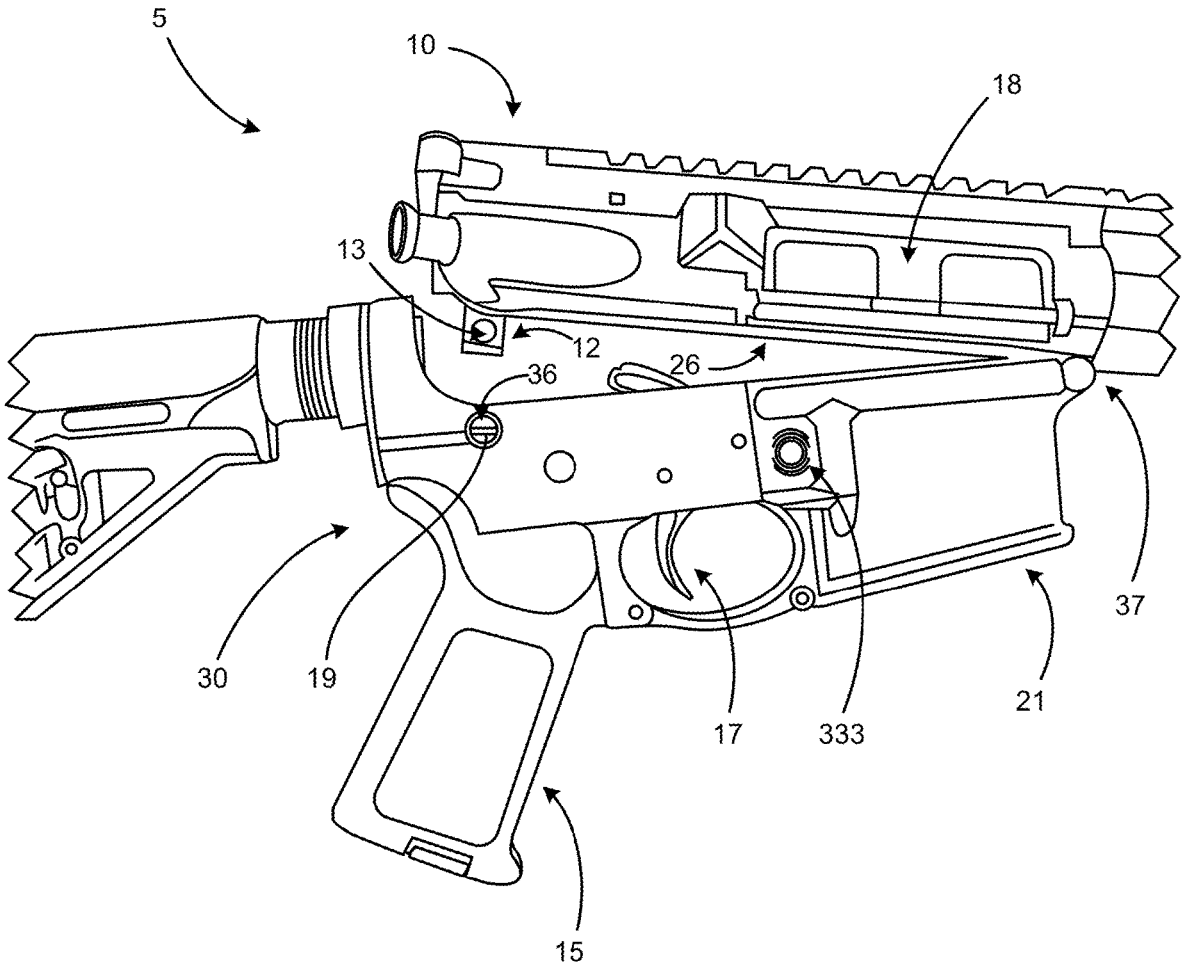
FIG. 5 is a side view of a firearm where the upper and lower receivers have been separated and a rear takedown pin has not been inserted.
Figure 15:
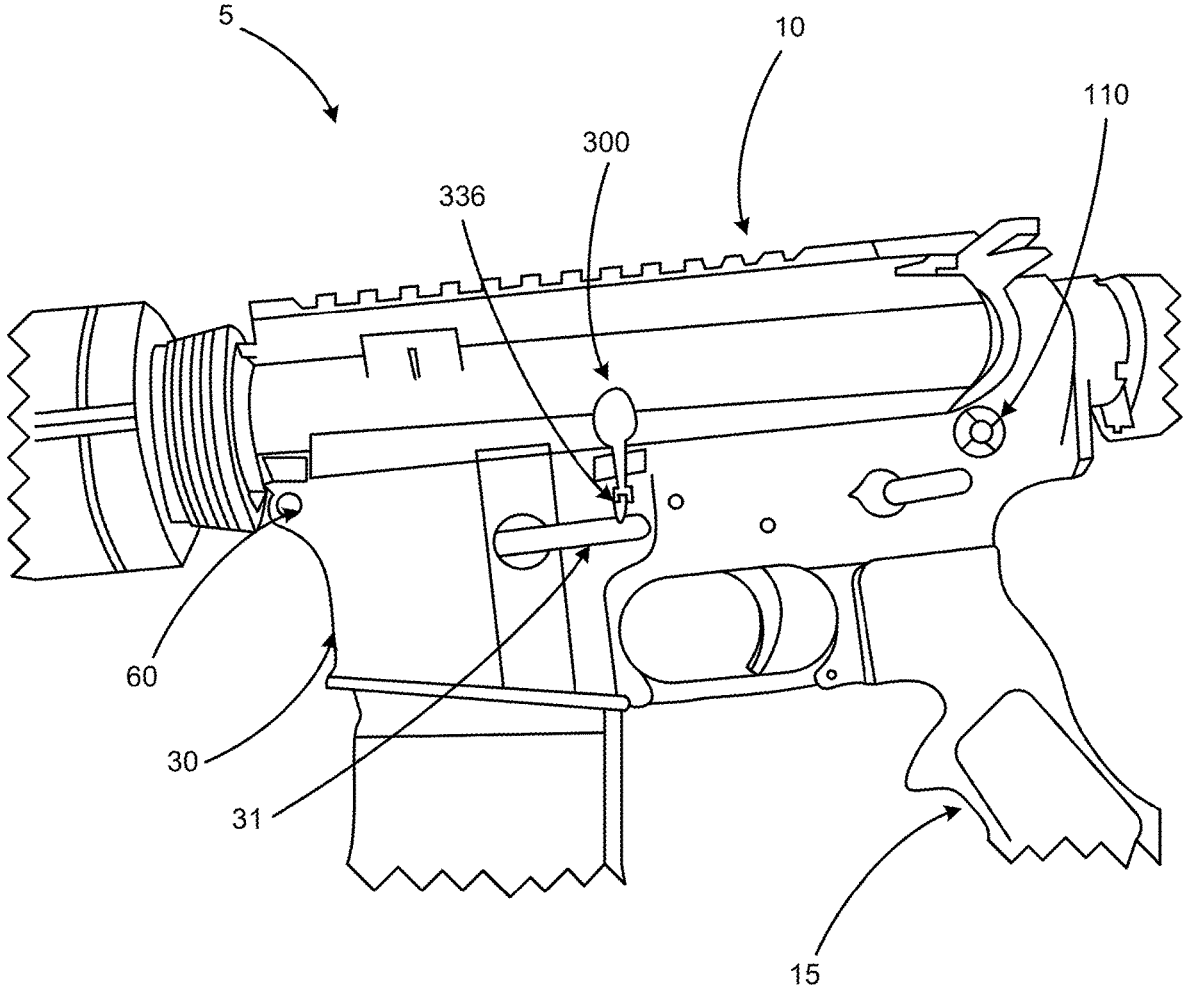
FIG. 15 is a side view of a firearm showing a rear takedown pin and bolt catch.

Turning now to the relative positioning of the rear takedown pin 100, 200 within a firearm 5, FIG. 5 shows a central portion of a firearm 5, such as an AR-15. The firearm 5 includes an upper receiver 10 that at least has a bottom surface 26 that lies adjacent along the lower receiver 30. As is standard with many firearms, the firearm also includes a grip 15, a trigger 17, an ejection port with ejection port cover 18. The upper receiver 10 includes a rear takedown lug 12 that has a lug hole 13. As shown in FIG. 5, the upper receiver 10 rotates along a rotation point 37 when the there is no rear takedown pin 100, 200 that passes through the lug hole 13, and rear takedown pin hole 36 on the lower receiver 10. The rotation point 37 can be secured via a front pivot pin 60 (as shown in FIG. 15). The firearm 5 also has a magazine attachment receiver 21 where the magazine (not shown) connects to the firearm 5. The lower receiver 30 also has a magazine release button 333.

Figure 6:
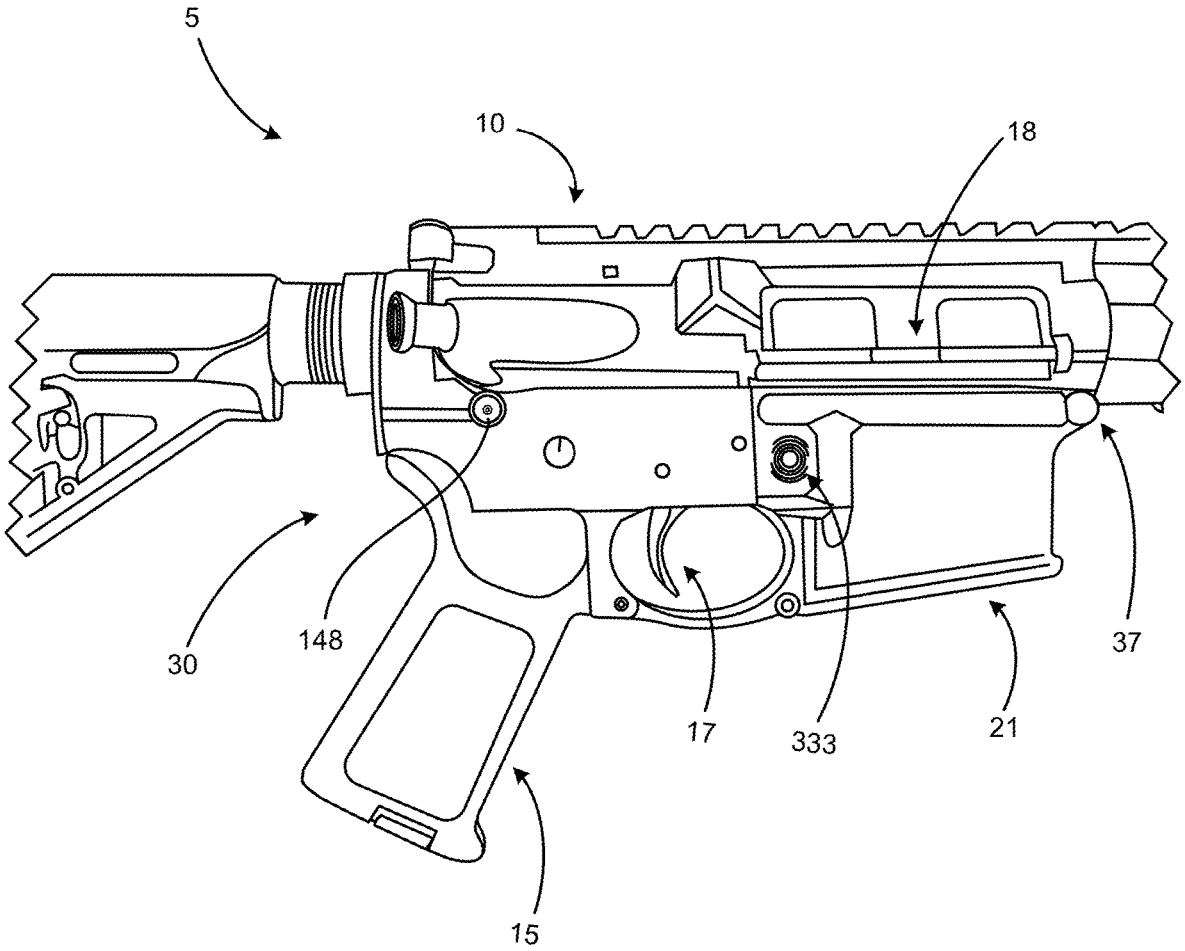
FIG. 6 is a side view of the firearm of FIG. 5 where the upper and lower receivers are locked and connected together, and a rear takedown pin has been inserted.

Referring now to FIG. 6, FIG. 6 illustrates the firearm 5 in its closed position such that the firearm 5 can be fired by the user. In this configuration, the pin has been inserted through the lower receiver takedown pin holes 34, 36 and the rear takedown lug hole 13. In this side view as shown in FIG. 6, only the end cap 148 of the rear takedown pin 100, 200 can be seen.

Figure 7:
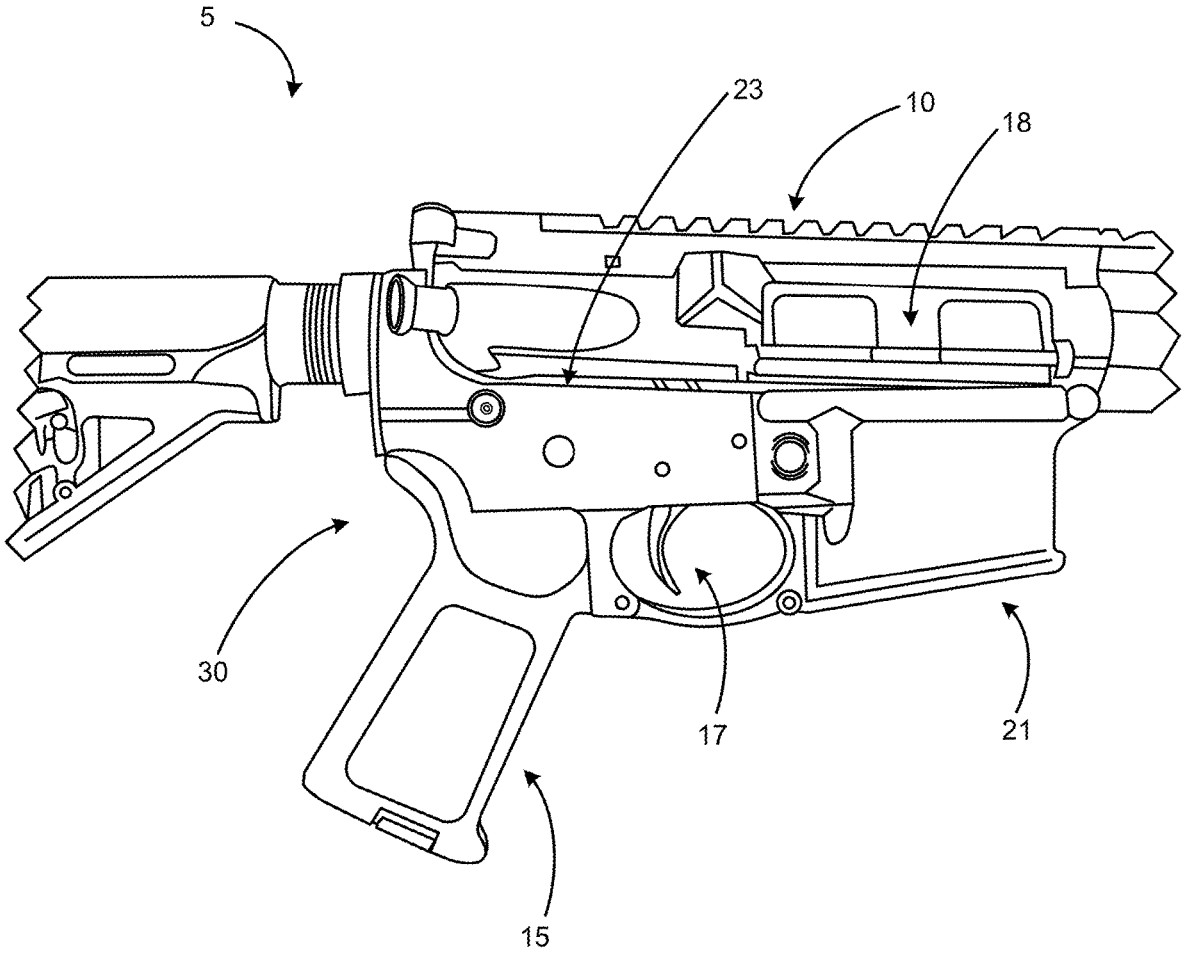
FIG. 7 is a side view of the firearm of FIG. 6 where the rear takedown pin has been inserted and the upper receiver and lower receiver are slightly separated, but prevented from fully separating due to the rear takedown only allowing slight separation of the receivers.

In the configuration shown in FIG. 6, the magazine cannot be in a releasable state according to many state's regulation because the upper receiver 10 and lower receiver 30 are connected and coupled together, which allows for firing of the firearm 5. In order to design around, but be compliant with the regulations to require the upper receiver 10 and lower receivers 30 to be separated from each other in order to release the magazine, the pin 100, 200 described above allows the firearm 5 to be in a configuration as shown in FIG. 7, where there is a partial and small separation between upper receiver 10 and lower receiver 30. This partial and small separation is shown as an upper and lower receiver small spacing 23 between the two receivers 10, 30. This spacing is important because the spacing 23 that separates the upper receiver 10 and lower receiver 30 makes the firearm 5 compliant by requiring the lower and upper receives 10, 30 to be disengaged in order to release the magazine, yet the small spacing 23 allows the user to effectively maintain aim and not require excess amounts of handling to release a spent magazine and insert a new magazine. The small spacing 23 is maintained by the specialized rear takedown pin 100, 200 that holds the upper receiver 10 and lower receiver 30 in a slightly disengaged configuration.

Figure 8:
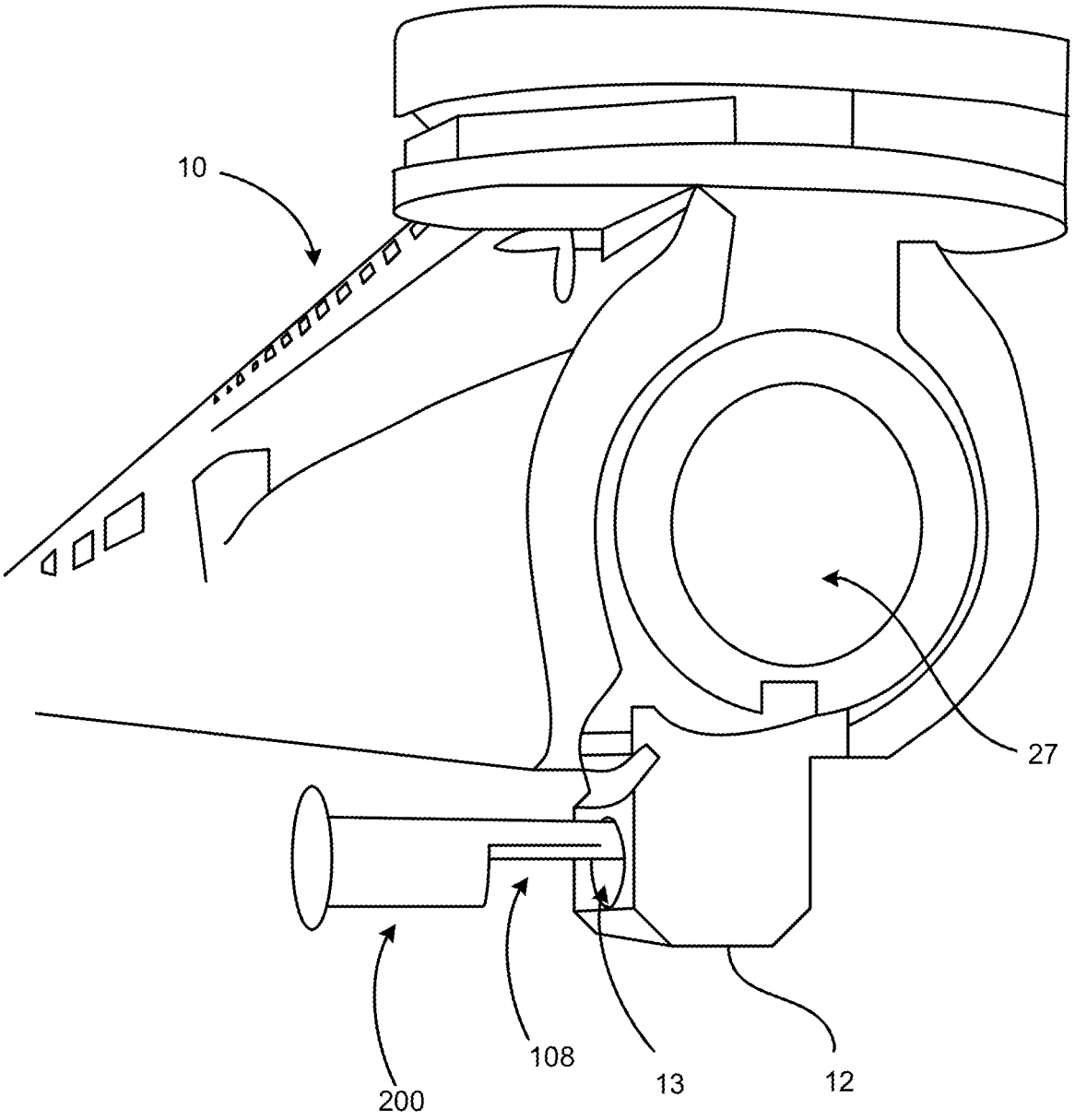
FIG. 8 is a perspective view of a portion of the upper receiver showing the rear takedown pin partially inserted through the lug of the upper receiver.
Figure 9:
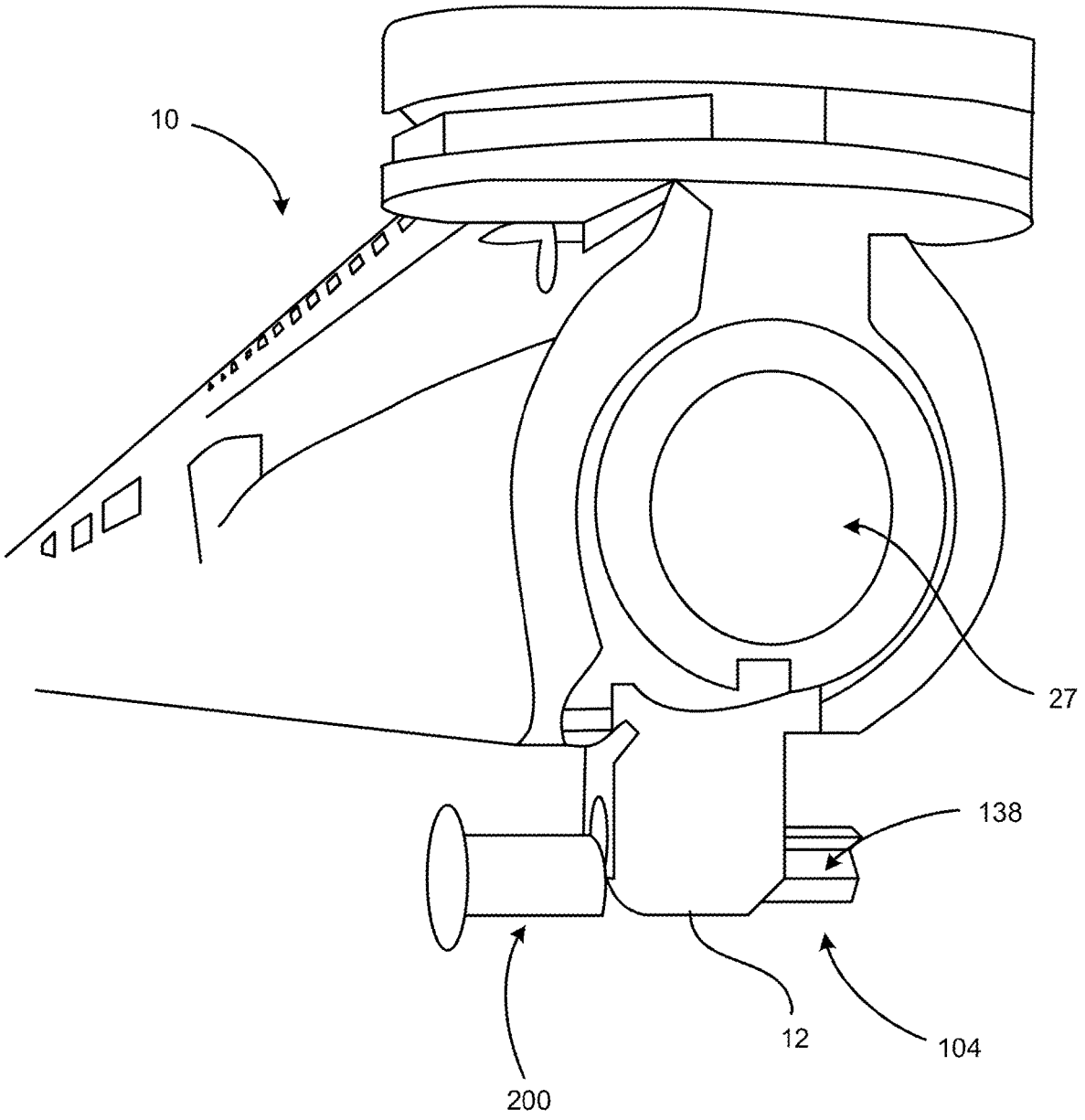
FIG. 9 is a perspective view of a portion of the upper receiver of FIG. 8 showing the rear takedown pin fully inserted through the lug of the upper receiver.
Figure 10:
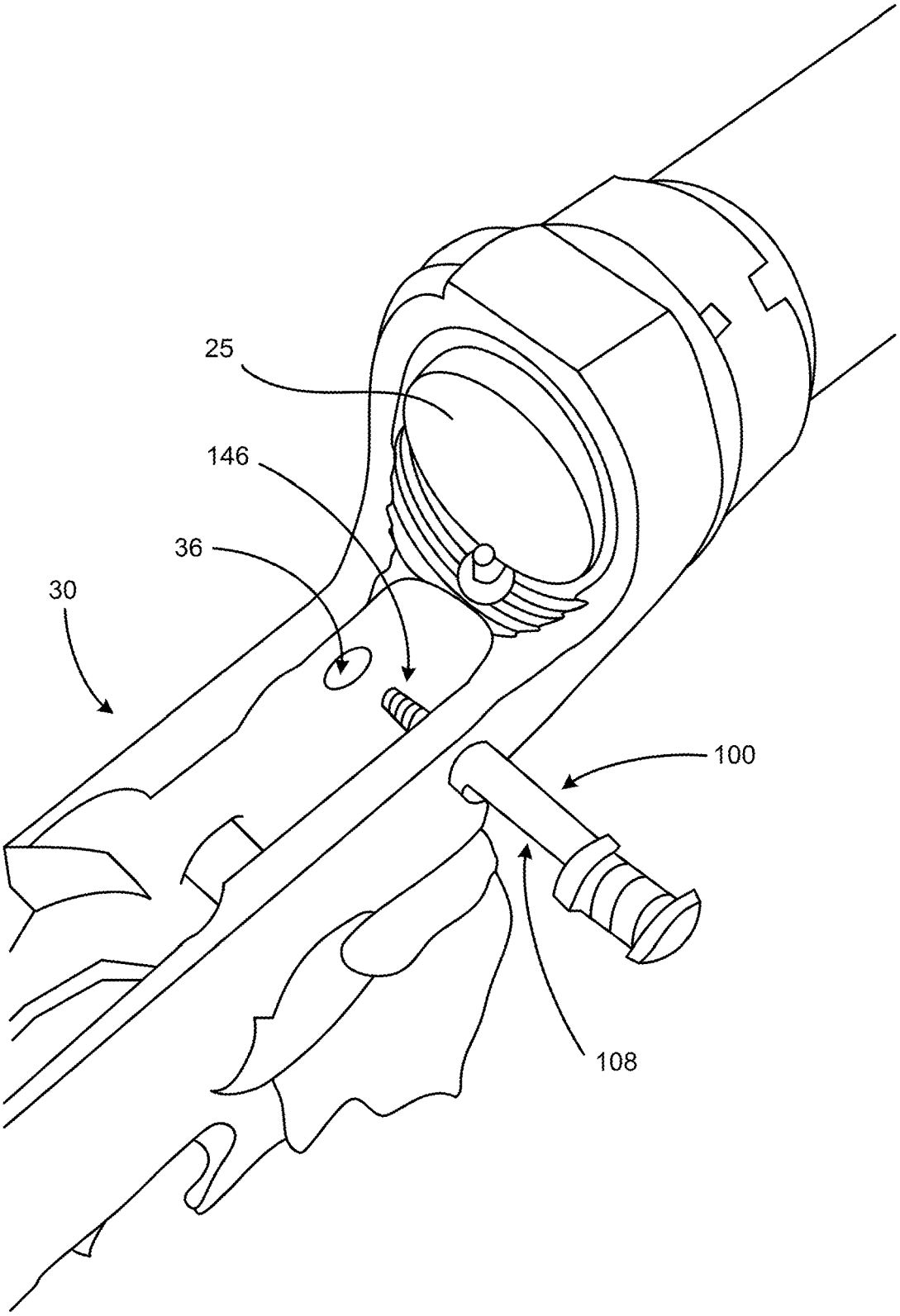
FIG. 10 is a right perspective view of a portion of the lower receiver where the rear takedown pin is partially inserted through the rear takedown pin hole.
Figure 11:
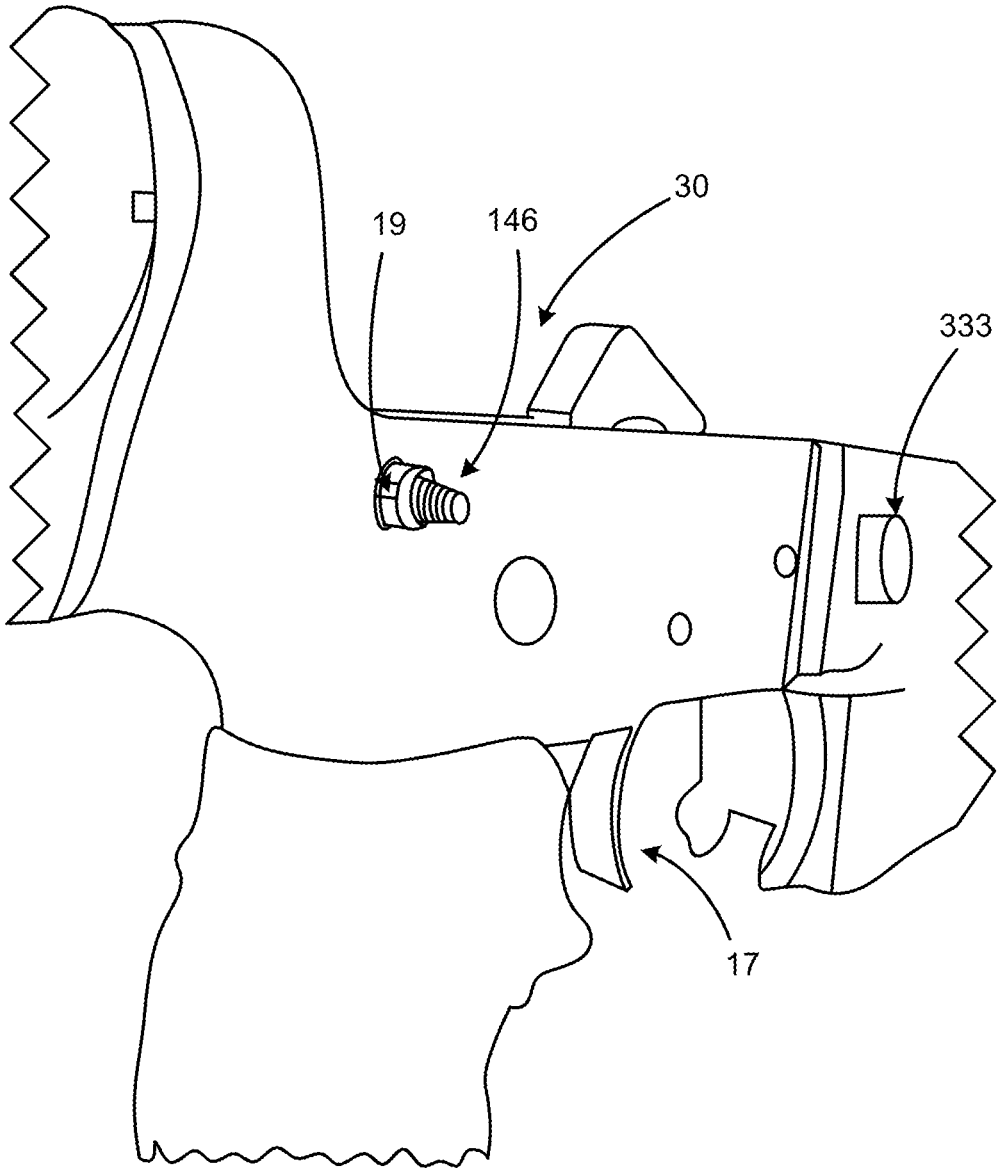
FIG. 11 is a left perspective view of the portion of the lower receiver of FIG. 10 where the rear takedown pin is fully inserted through the rear takedown pin hole.
Figure 12:
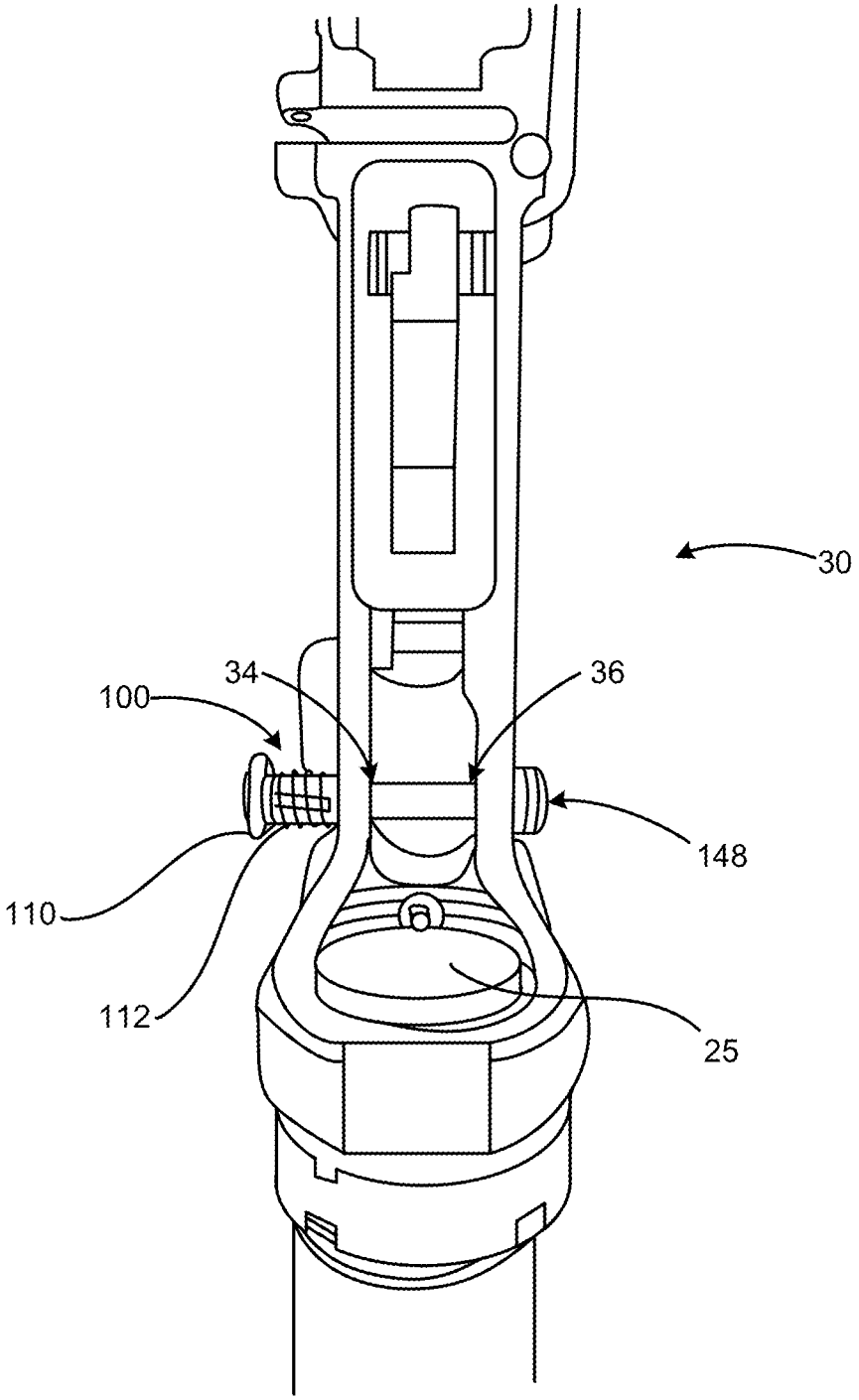
FIG. 12 is a top view of the portion of the lower receiver of FIG. 11 where the rear takedown pin has been fully inserted through the rear takedown pin hole.

The inner views showing how the rear takedown pin 100, 200 is able to accomplish this the partial separation, yet maintain coupling is illustrated by showing the rear takedown pin 100, 200 in the upper receiver 10 and lower receiver 30, separately, as shown in FIGS. 8-10. In FIGS. 8 and 9, one embodiment of the pin 200 is shown partially inserted through just the rear takedown lug hole 13. FIG. 9 illustrates the pin 200 fully inserted through the lug hole 13 such that the recess 108 can fit around the lug 12. FIG. 10 aids in understanding the correct positioning of the pin 100, 200 to accomplish the partial separation and maintain coupling between the upper receiver 10 and lower receiver 30, where the pin 100 inserted just through the holes 34, 36 in the lower receiver 30 from the left side, as it is being pushed through. Now turning to FIG. 11, FIG. 11 illustrates the opposing side of FIG. 10, with the projection 146 of the rear takedown pin 100, 200 exposed, after it has been fully inserted through the holes 34, 36. The detent 19, as discussed previously, fits into the distal end track 138 (shown in FIG. 9.). A top view of only the lower receiver 30 shows one embodiment of the pin 100 inserted all the way through, and secured with the end cap 148. When in actual use, the upper receiver 10 is positioned on top of the lower receiver 30 and the pin also traverses the rear takedown lug hole 13.

Additional components of the firearm 5 include a barrel 27 (see FIGS. 8 and 9) where bullets are expelled, and a bolt 25 (see FIGS. 10 and 12) that is released from a cocked position when a user pulls the trigger 17 (FIGS. 6, 11, 15), thereby releasing the bolt 25 to make contact with a bullet at the top of the magazine.

Figure 13:
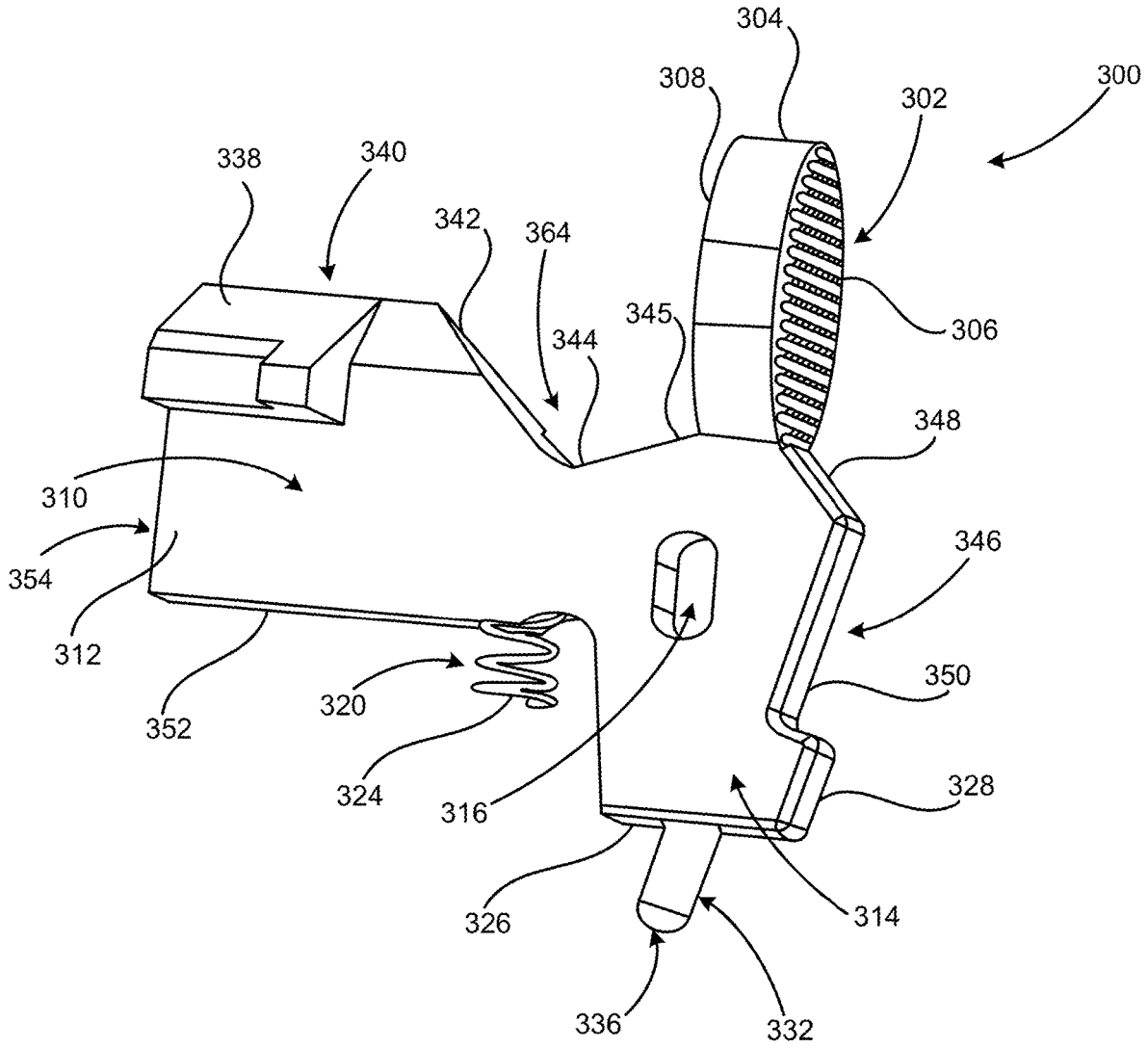
FIG. 13 is a perspective view of one embodiment of a bolt catch.
Figure 14:
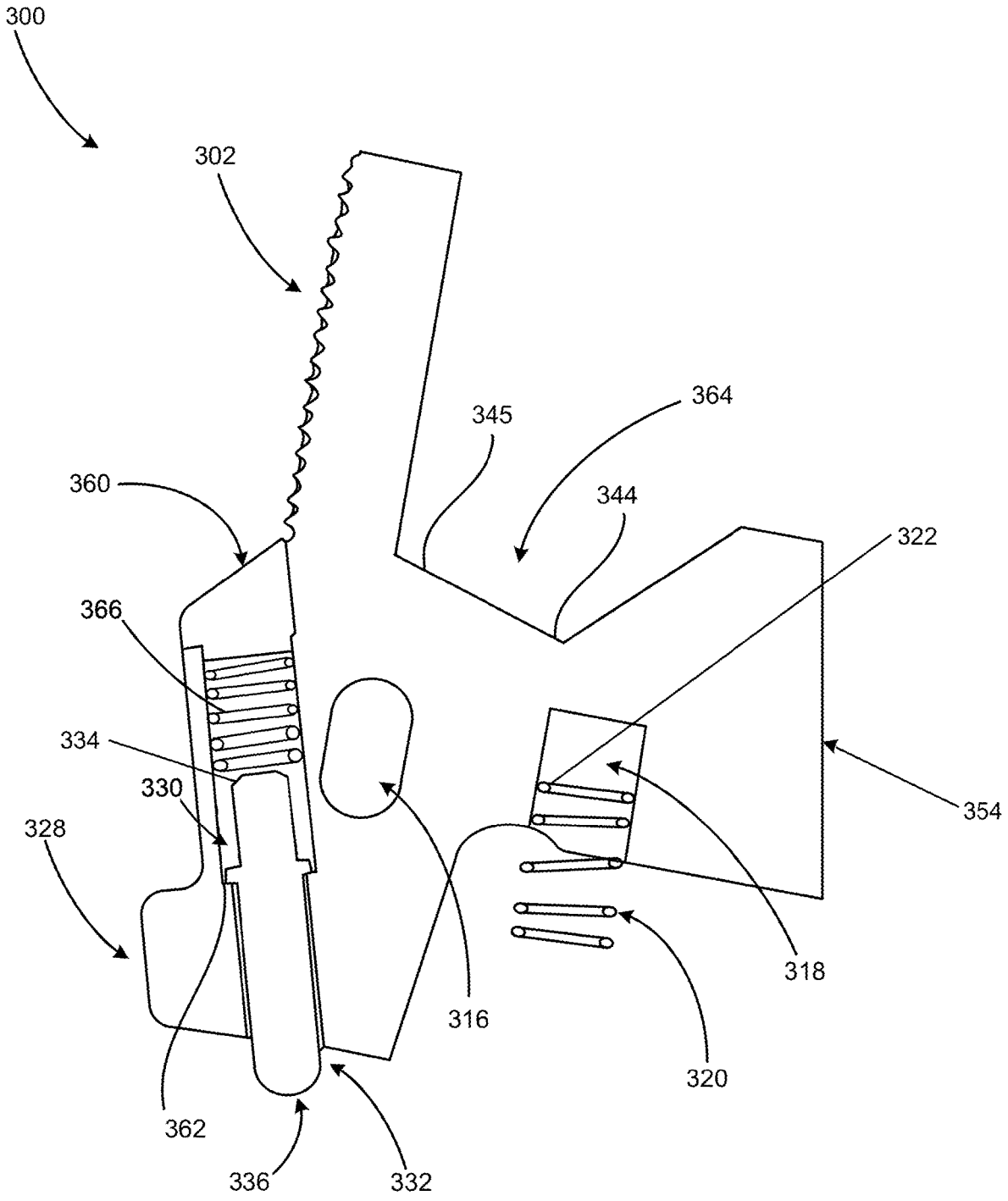
FIG. 14 is a cross sectional view of one embodiment of a bolt catch.

It is another object of the present invention to provide a bolt catch 300, shown in isolation in FIGS. 13 and 14, and positioned with reference to placement on a firearm 5 in FIG. 15. FIG. 13 shows a perspective view of the bolt catch 300 and FIG. 14 a cross sectional view of the embodiment.

The purpose of a bolt catch 300 is to stop the bolt carrier group (BCG) from traveling forward and contacting a round. The bolt carrier group is the heart of an AR-15 and houses the bolt, firing pin, and other components to fire a bullet. The bolt catch 300 enables a bolt 25 (shown in FIGS. 10 and 12) to be locked in a rearward position after expending a magazine so that a new magazine can be inserted. To enable the bolt 25 to be operational again, the bolt catch 300 is pressed by the user so the bolt is no longer locked in the rearward position, and may move forward to contact a round in the firearm when the user pulls the trigger 17.

In normal operation, using a traditional bolt catch, rounds in a magazine keep the bolt catch 300 in a position that allows the bolt carrier group (BCG) to slide forward. When the last round is fired, the bolt catch 300 pops up and engages the bolt carrier group such that it remains in a retracted (i.e. rearward) position. The bolt catch 300 in the present invention is novel and inventive because it is capable of not only keeping the bolt 25 in its retracted position, but also functions as being the means to keep the magazine of the firearm in a magazine-locked, or magazine-releasable configuration via the use of manually pressable magazine release blocking pin 332 on the bottom side 326 of the bolt catch 300. Thus, this type of bolt catch 300 has multiple function, not seen in the prior art. Common bolt catches are not California compliant because the pin 332 does not block the rear side of the magazine release button 31, but only functions to catch a retracted bolt 25. In the present embodiment of a bolt catch 300, the bolt catch 300 is California compliant because, by default, a pin 332 blocks the magazine release button 333 from being able to be pressed by blocking the rear side of the magazine release button 31 being able to be moved, thereby keeping the magazine in a locked position. However, the user can manually retract the magazine release blocking pin 332 upwards into the bolt catch 300 so it no longer blocks the magazine release button 333 from being pressed.

In traditional bolt catches, the only purpose of the bolt catch is to catch the BCG, but because of the combination of the spring, the elongated hole and the pin, not only can the present bolt catch 300 catch the BCG in its retracted position, but the bolt catch 300 can either keep the magazine release in an operable or inoperable configuration to be California compliant.

Turning specifically to FIGS. 13 and 14, the bolt catch 300 has a main body 310 that is substantially L-shaped, a pad 302 for pressing (generally by thumb, to actuate the release), a bolt catch engaging tab 338, and a toggle portion 328. The main body 310 comprises a first leg 312 and a second leg 314 that is integral and substantially perpendicular to the first leg 312 in some regions, and angled slightly toward the first leg 312 in other regions. The first leg 312 has a first leg bottom side 352, and a first leg top side 340 and a first leg rear side 354. Integral and toward the rear of the first leg 312 is a bolt catch engaging tab 338 that catches the bolt 25 to keep it in the retracted position.

The first leg 312 includes an angled first top side facet 342 angled downward through a top side recess 364, leading to second top side facet 344 that angles up toward to pad 302 to form a top angled region 345. The bolt catch 300 can be in a stable position and not able not able to rise up and down when the upper and lower receivers 10, 30 are in the locked and engaged configuration. The angles and positioning of the facets 342, 344, and angled regions 345 enable the bolt catch 300 to slide in and out of a locked and unlocked position when inserted into the firearm such that bolt catch 300 can be positioned to lock the BCG in a retracted position, and allow the pin 332 to be in a position that blocks the rear side of the magazine release button 31.

The first leg bottom side 352 includes a bottom side hole 318 (illustrated in FIG. 14) sized and shaped to fit a bolt catch spring member 320. The bolt catch spring member 320 has a proximal end 322 and a distal end 324.

When the magazine of the firearm 5 is empty, the bolt catch tab 338 rises up, due to spring force caused by a bolt catch spring member 320 pressing against the lower receiver 30, which blocks the BCG having the bolt 25 from going forward, and keeps the BCG in the retracted position. When the user then exchanges the empty magazine with a loaded magazine, the bolt catch 300 remains in the lower position such that the bolt catch tab 338 does not rise to a position where it catches and locks the BCG having the bolt 25.

In firearm parts that are California compliant, the bolt catch 300 cannot automatically catch the BCG having the bolt 25 when the last round is fired, and to be California complaint, in the present invention, the user has the option, though not the default, to manually push in the manual magazine release blocking pin 332 such that the user can press the magazine release button 333 to release the magazine. In current bolt catches, this feature does not exist and there is no California compliant option for making the magazine releasable when the last round has been spent. However, in the present invention, the bolt catch 300 by default California compliant, but the user has the option to manually push the pin 332 so the magazine can be released. Other bolt catches without these features do not act both as a bolt catch and a magazine lock.

With respect to other features of the bolt catch 300, the pad 302 has a top 304, a front 306, and rear region 308, and is typically an oval-shaped disc, though the pad 302 can take a variety of shapes without detracting from the spirit of the invention. The pad 302 is integral to the second leg 314 and extends substantially along the same axis of the second leg 314.

The bolt catch 300 has a front side 346 of that extends downward from the pad 302, and the front side 346 has a plurality of facets, including a first front side facet 348 angled forward from the pad 302. A second front side facet 350 is angled rearward from the first front side facet 348 and forms to a toggle portion 328 near the bottom of the second leg 314. The second leg has a bottom side 326 that has a second leg hole 330. The second leg hole 330 is sized, shaped and adapted to fit a magazine releasing blocking pin 332 having a proximal end 334 and a distal end 336, such that when the pin 332 is in its projected-out orientation, the pin 332 covers the rear side of the magazine release button 31 (as shown in FIG. 15). To retain the pin 332 within the hole 330, the pin 332 may have a blocking pin retaining lip 362, and the lip 362 has a circumference larger than the bottom of the second leg hole 330 so that the pin 332 cannot fall out of the bolt catch 300.

To prevent the blocking pin 332 from falling out the top side of the bolt catch 300, a second leg hole cap 360 may be put on the on the top side of the second leg hole 330. To uncover the rear side of the magazine release button 31, a user can manually push up the blocking pin 332 so that it retracts into the second leg 314, thus allowing the rear side of the magazine release button 31 to be exposed, which allows a user to release a magazine by pressing the magazine release button 333 (shown in FIGS. 1 and 2). The pin 332 in the present embodiment is advantageous because it allows the firearm 5 to be compliant with laws that require a magazine to be in a locked position when the bolt 25 is not locked in a retracted position.

In preferred embodiments, the magazine release blocking pin 332 projects at an angle toward the longitudinal axis of the bolt catch 300 so that the pin braces against the rear side of the magazine release button 31. The pin 332 may be held in its projected state via the use of a second spring 366 within the hole 330 of the second leg 314. Force exerted by the second spring member, adjacent the magazine release blocking pin 332, forces the magazine release blocking pin 332 to project downward unless manually retracted upward by a user, thereby having the default position of the magazine release blocking pin down in a blocking position.

Within the bolt catch main body 310, below the pad 302, and within the second leg 314 is an elongated main body aperture 316, where a pin is generally inserted that allows the bolt catch 300 to rotate and rise or lift when the user presses the pad 302. Having the aperture 316 elongated or oblong, such as oval shaped, as shown, instead of circular, allows the bolt catch 300 to not just swivel around a specific axis, but also rise and lower with respect to the pin (not shown) that secures the bolt catch to the firearm 5. This elongated main body aperture 316 allows the magazine release blocking pin 332 to rise up with the entirety of the bolt catch 300, such that the magazine release blocking pin 332 no longer blocks the rear side of the magazine release button 31 because the spring member 320 is able to push the bolt catch 300 up. In contrast, if the hole were not elongated, the bolt catch 300 could not both pushed up vertically and swivel, but rather, could only swivel.

Alternatively, when the bolt catch 300 is not raised by the user pressing the pad 302, the user can still manually raise the magazine release blocking pin 332 to expose the rear side of the magazine release blocking button 31 so that the user can release the magazine when the user presses the magazine release button 333. In other words, there are two ways for the magazine release blocking pin 332 to go up, either by pressing the pad 302 which, raises the pin 332, or by raising the pin 332 manually.

Specifications of the bolt catch 300 can have a variety of dimensions. The dimensions may be plus or minus 5%, 10%, 15%, 20%, 25%, 30%, 35%, 40% or more or less depending on the size of the firearm without detracting from the spirit of the invention. In a preferred embodiment, the height of the rear side of the first leg 354 is 131.1 mm, the height of the bolt catch tab 338 is 7.6 mm, the length of the first leg bottom side 352 to the middle of the first leg hole is approximately 15 mm, the width of the pad 302 is 3.0 mm, the length of the elongated main body aperture 316 is approximately 4.4 mm, the width of the elongated main body aperture 316 is approximately 2.8 mm, the length of the bottom side of the second leg 314 of the main body is approximately 7.5 mm, the length of the toggle portion is approximately 3.5 mm, the length of the front side of the bolt catch 346 is approximately 15 mm, the length of the top side recess 364 from the beginning of the recess to the pad 302 is approximately 6.6 mm. In other embodiments, the elongated main body aperture is between 4 mm and 5 mm in length and between 2 mm and 3 mm in width. The dimensions of the elongated main body aperture 316 allows for sufficient rotation around the axis of rotation pin within the elongated main body aperture and also allows for the bolt catch to rise and lower in response to force exerted by the spring member. The length of the entirety of the bolt catch 300 is approximately 30 mm from the rear side of the first leg 354 to the most forward portion of the second front side facet 346. The angle of the pin 332 with respect to the bottom side of the second leg 326 is at a non-perpendicular angle, and preferably is approximately ten degrees offset from the vertical axis of the bolt catch 300 (or 80 degrees from the horizontal second leg bottom side 326). The angle of the pin may be between five degrees and twenty degrees offset from the vertical axis of the bolt catch. This angle may but also may vary with 5%, 10%, 15%, 20%, 25%, 30%, 35%, or more.

The following reference numbers are used throughout the Figures:

5 Firearm (AR-15)
10 Upper receiver
12 Rear takedown lug
13 Rear takedown lug hole
15 Firearm grip
17 Trigger
18 Ejection port cover
19 Detent
21 Magazine attachment receiver
23 Spacing (between upper and lower receivers)
26 Bottom surface of upper receiver
30 Lower receiver
34 Lower receiver takedown pin hole (first)
36 Lower receiver takedown pin hole (second)
37 Rotation point (Pivot connection between upper and lower receiver)
100 Rear takedown pin (outside spring embodiment)
102 Elongated cylindrical body (ECB)
104 Distal end of ECB
106 Proximal end of ECB
108 Elongated recess
110 Knob
112 Spring member
114 First end of spring member
116 Second end of spring member
118 Ring member
120 Outer circumference of ring member
122 Rib of ring member
124 Slot on the end of the cylindrical body
126 Distal end of slot
128 Proximal end of slot
130 Outer circumference of ECB
132 Hollow proximal end of ECB
134 Proximal end of elongated recess
136 Distal end of elongated recess
138 Track
140 Proximal end of track
142 Distal end of track
144 Tapered region
146 Projection (for end cap)
148 End cap
150 Receiving hole of end cap
152 Threads (on projection)
154 Recess in knob
200 Rear takedown pin (inside spring embodiment)
300 Bolt catch release lever
302 Pad
304 Top of pad
306 Front of pad
308 Rear of pad
310 Main body of bolt catch release lever (substantially L-shaped)
312 First leg of main body
314 Second leg of main body
316 Elongated main body aperture
318 First leg hole (bottom side)
320 Spring member
322 Spring member proximal end
324 Spring member distal end
326 Bottom side of bolt catch second leg
328 Toggle portion
330 Second leg hole
332 Magazine release blocking pin
334 Proximal end of release blocking pin
336 Distal end of release blocking pin
338 Bolt catch tab
340 Top side of first leg
342 First top side facet
344 Second top side facet
345 Top angled region
346 Front side of bolt catch
348 First front side facet
350 Second front side facet
352 First leg bottom side
354 Rear side of first leg
360 Second leg hole cap
362 Blocking pin retaining lip
364 Top side recess
366 Second spring (in second leg hole)

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

What is claimed is:

1. A bolt catch device for a firearm, the firearm having a bolt that slides between a latched and an unlatched position, the device comprising:

a) a main body that is substantially L-shaped, the main body having a first leg and a second leg substantially perpendicular to the first leg;
b) a bolt catch tab for catching a bolt;
c) a spring member disposed within a hole in the first leg of the main body;
d) a magazine release blocking pin at least partially disposed and partially retractable within a hole on a bottom side of the second leg;
e) a pad for toggling the bolt catch into a latching and unlatching position for a bolt;

and, f) an elongated main body aperture sized i) to fit a rotation pin that allows the bolt catch to rotate around the rotation pin and ii) to allow the bolt catch to rise and lower in response to force exerted by the spring member;

whereby the bolt of the firearm is held in a latched position by interaction of the bolt with the bolt catch, and the bolt catch is configured to allow latching and unlatching of the bolt by a user.

2. The bolt catch device of claim 1 wherein the pad is an oval-shaped disc.

3. The bolt catch device of claim 1, wherein the magazine release blocking pin is positioned at a non-perpendicular angle from the bottom side of the second leg.

4. The bolt catch device of claim 3, wherein the magazine release blocking pin is between five degrees and twenty degrees offset from the bottom side of the second leg.

5. The bolt catch device of claim 4, wherein the magazine release blocking pin is approximately ten degrees offset from the bottom side of the second leg.

6. The bolt catch device of claim 3, wherein the elongated main body aperture is between 4 mm and 5 mm in length, and between 2 mm and 3 mm in width, whereby dimensions of the elongated main body aperture i) allows for sufficient rotation around an axis of the rotation pin within the elongated main body aperture and ii) allows the bolt catch to rise and lower in response to force exerted by the spring member.

7. The bolt catch device of claim 1 further comprising a second spring member, the second spring member disposed with the second leg of the main body adjacent the magazine release blocking pin, whereby force exerted by the second spring member forces the magazine release blocking pin to project downward unless manually retracted upward by a user, thereby having a default position of the magazine release blocking pin down in a blocking position.

* * * * *